US009540860B2

(12) United States Patent
Antonetti

(10) Patent No.: US 9,540,860 B2
(45) Date of Patent: Jan. 10, 2017

(54) OPEN TOP HOPPER WINDOW AND FRAME

(71) Applicant: Oscar Anselmo Antonetti, Prov. de Buenos Aires (AR)

(72) Inventor: Oscar Anselmo Antonetti, Prov. de Buenos Aires (AR)

( * ) Notice: Subject to any disclaimer, the term of this patent is extended or adjusted under 35 U.S.C. 154(b) by 0 days.

(21) Appl. No.: 14/879,171

(22) Filed: Oct. 9, 2015

(65) Prior Publication Data

US 2016/0102491 A1 Apr. 14, 2016

(30) Foreign Application Priority Data

Oct. 10, 2014 (AR) ..... P20140103787

(51) Int. Cl.

| | |
|---|---|
| ***E06B 3/50*** | (2006.01) |
| ***E05D 15/40*** | (2006.01) |
| ***E05D 15/44*** | (2006.01) |
| ***E05C 3/14*** | (2006.01) |

(52) U.S. Cl.

CPC ..... *E06B 3/5018* (2013.01); *E05C 3/145* (2013.01); *E05D 15/406* (2013.01); *E05D 15/408* (2013.01); *E05D 15/44* (2013.01)

(58) Field of Classification Search

CPC ..... E06B 3/5018; E06D 15/406; E05C 3/145
USPC ..... 49/176, 187, 246, 253, 394
See application file for complete search history.

(56) References Cited

U.S. PATENT DOCUMENTS

| | | | | | |
|---|---|---|---|---|---|
| 1,696,607 | A | * | 12/1928 | Hysert | 49/155 |
| 1,760,994 | A | * | 6/1930 | Piotti | 49/252 |
| 1,919,371 | A | * | 7/1933 | Klemm | 49/155 |
| 2,027,240 | A | * | 1/1936 | Looney | 49/155 |
| 2,036,151 | A | * | 3/1936 | Lang | 292/112 |
| 2,266,076 | A | * | 12/1941 | Reynolds | 49/155 |
| 2,648,878 | A | | 8/1953 | Albano | |
| 2,718,675 | A | | 9/1955 | Olsen | |
| 2,796,639 | A | * | 6/1957 | Reynolds | 49/155 |
| 2,825,939 | A | | 3/1958 | Teggelaar | |
| 3,721,044 | A | | 3/1973 | Kvasnes | |
| 3,722,142 | A | | 3/1973 | Anderberg et al. | |
| 4,102,012 | A | | 7/1978 | Davis | |
| 4,679,352 | A | * | 7/1987 | Bates | 49/192 |
| 4,783,131 | A | | 11/1988 | Grass | |
| 4,807,914 | A | * | 2/1989 | Fleming et al. | 292/48 |
| 6,823,626 | B2 | * | 11/2004 | Kinsey | 49/187 |
| 6,988,334 | B2 | * | 1/2006 | Kinsey | 49/187 |
| 7,305,795 | B1 | * | 12/2007 | Tooman | 49/164 |
| 2012/0174487 | A1 | * | 7/2012 | Lambertini | 49/353 |

* cited by examiner

*Primary Examiner* — Jerry Redman
(74) *Attorney, Agent, or Firm* — Young & Thompson

(57) ABSTRACT

Disclosed is an open top hopper window with a hopper window and a frame. The frame includes top edge and bottom edges, and left and right sides. The inn part of the right and left sides of the frame has a guide groove located at the bottom of the side, with a hole in the frame located above such guide groove. The joining between the hopper window and the frame uses two bolts at the outer bottom sides of the hopper window sliding into the guide grooves and two arms linking the holes at the frame with two holes at the hopper window wherein the two holes are located at the 35%-40% range of the total length of the hopper window on the outer sides of the hopper window always achieving an equilibrium position which allows positioning the hopper window at different opening angles and positions without effort.

3 Claims, 10 Drawing Sheets

OPEN TOP HOPPER WINDOW AND FRAME

FIELD OF THE INVENTION

This invention relates to the field of an open top hopper windows for houses, homes and factories. Hopper windows allow regulating ventilation at the room where they are set up.

OBJECT OF THE INVENTION

This invention relates to an open top hopper window with its frame allowing infinitesimal lifting at different opening angles.

The joining between the hopper window and the frame is achieved by means of arms located at specific places on the window thus allowing its imbalance easing its lifting by little effort.

BACKGROUND OF THE INVENTION

U.S. Pat. No. 2,648,878 relates to a fully reversible hopper window. Such window has two arms that support the window and bottom guides in which it slides. However, the position of the arms is in the middle (50%) of the hopper window, preventing its imbalance that eases lifting it by very little effort.

U.S. Pat. No. 2,718,675, similar to the above patent, shows a reversible hopper window frame with two arms and sliding guides. However, this patent uses sliding arms that do not allow its imbalance that eases lifting it by very little effort.

U.S. Pat. No. 2,825,939 relates to assemblies for hopper windows. On this invention, the guides for hopper windows on top of the frame, thus it is a bottom open window; once opened, users get the air directly into their bodies without proper regulation. Furthermore, there is no imbalance allowing easy lifting by very little effort.

U.S. Pat. No. 3,721,044 shows a hopper window with double arms on each side which also improves the braking system. As on the above patent, the guides are on top of the frame and it has grooves therein. Furthermore, the guide system has a rotatable flange circulating on the frame groove that works as guide. It has no imbalance that eases lifting it by very little effort.

U.S. Pat. No. 3,722,142 shows a brake system for hopper windows using crossed arms. This system is very different than the above ones; it is used in open bottom hopper windows different than the one of this invention.

U.S. Pat. No. 4,102,012 relates to sliding hopper windows with upper and lower arms on each side, being also a system different to the one shown herein. As above, this system is used in open bottom hopper windows different than the one of this invention.

U.S. Pat. No. 4,783,131 relates to a locking system for cupboard doors. It has similar movements than the ones of this invention, as well as side guides for sliding on the bottom of the door.

SUMMARY OF THE INVENTION

This invention relates to an open top hopper window designed so as to allow the ventilation of houses, homes and factories preventing that the incoming air directly hits on people, thus also preventing them from suffering colds.

The open top hopper window of this invention is made up by a hopper window (1) and a frame (2), wherein the frame comprises a top edge (22), a bottom edge (23), a left side (16) and a right side (17), wherein the inner part of the right and left sides of the frame (16 and 17) has a guide groove (4) located at the bottom of the right and left sides with a hole on the frame (14) located above each guide groove (4), wherein the joining between the hopper window (1) and the frame (2) is achieved by means of two bolts (18) located on the sides of the bottom external part of the hopper window (1) moving within such guide grooves (4) and through two arms (3) joining the holes of the frame (14) with two holes (21) located on the hopper window (1), on such open top hopper window, the two holes (21) are located at 35%-40% of the total length of the hopper window (1) on the outer side of the hopper window (1) providing always a balanced position that allows positioning the hopper window at different opening angles and heights without any efforts to move it.

On the open top hopper window mentioned, the length of the two arms (3) joining the hopper window (1) with frame (2) corresponds to 50% of the total length of the hopper window.

The two arms (3) consist of two bars, each one having at one end a first bolt (19) that fits into the hole in the frame (14) and a second bolt (7) at the other end of each bar located opposed to the first bolt (19) and fitting into the hole (21) of the hopper window.

On the open top hopper window, according to this application, it can include at least one locking mechanism located at the sides of the hopper window (1), wherein such locking mechanism comprises at least a half endless screw (9) with helical threads, an axis of the half endless screw (6), a gear (8) having a gear axis hole (15), with helical teeth separated by tooth spaces with its respective axis perpendicular to the axis of the half endless screw (6), a handle (5) attached to the axis of the half endless screw (6), wherein the second bolt (7) of the arms (3) comprises such axis of the gear and when the handle (5) is half twisted, the half endless screw (9) of the gear (8) locks or unlocks.

On a preferred embodiment of the open top hopper window, the hopper window (1) comprises the joining of "U" profiles (11) that make up its four sides.

On another preferred embodiment of the open top hopper window, the axis of the half endless screw (6) crosses both sides of the "U" profile (11) through two aligned holes (12 and 13) located respectively on each side of the "U" profile (11) making up the sides of the hopper window.

BRIEF DESCRIPTION OF THE DRAWINGS

In order to understand this description better, the attached drawings show a non limiting embodiment of the object of this invention.

DETAILED DESCRIPTION OF THE INVENTION

Figure 1:
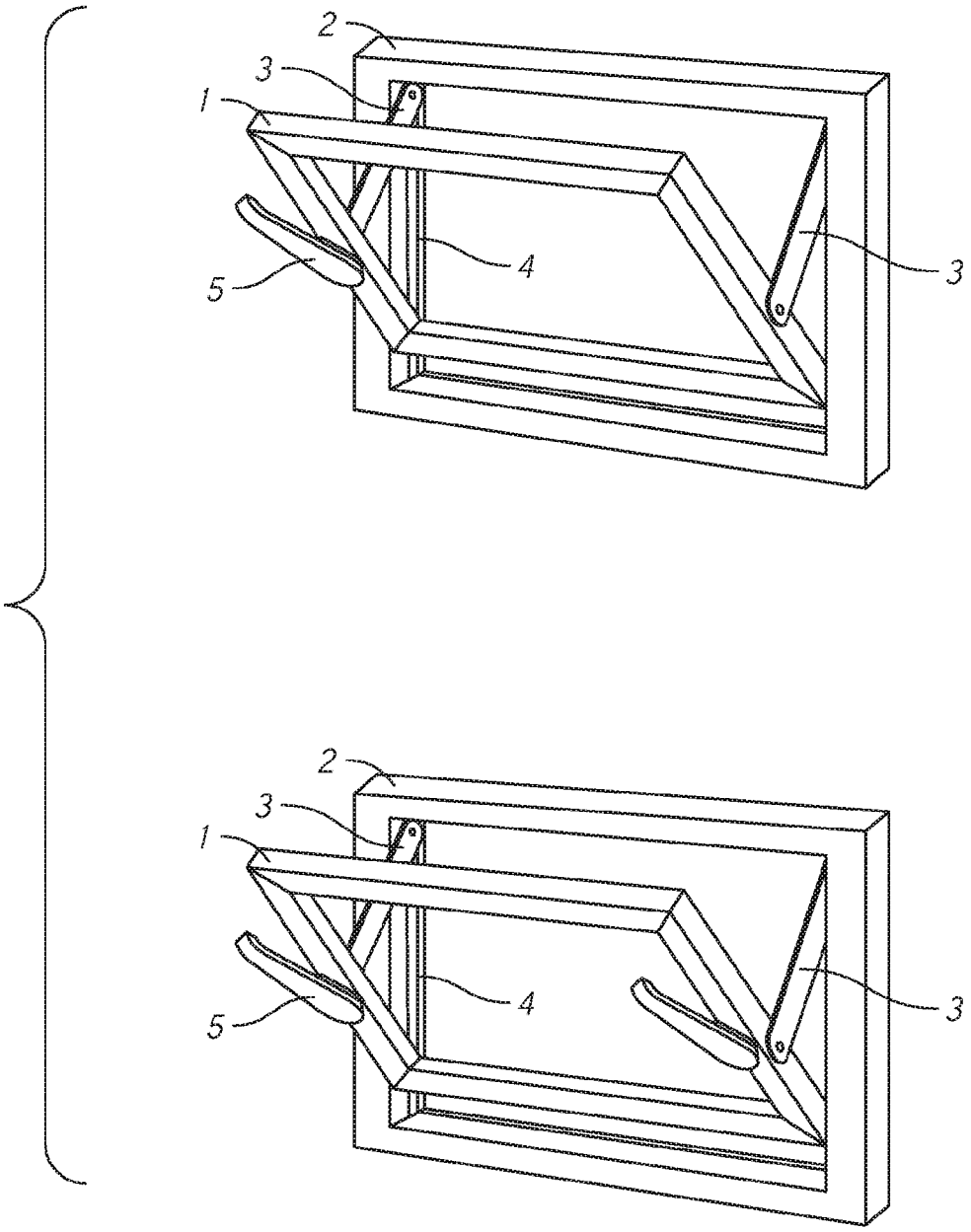
FIG. 1 shows two options of the open top hopper window; the top drawing with a single locking handle and the bottom drawing with two locking handles.
Figure 4:
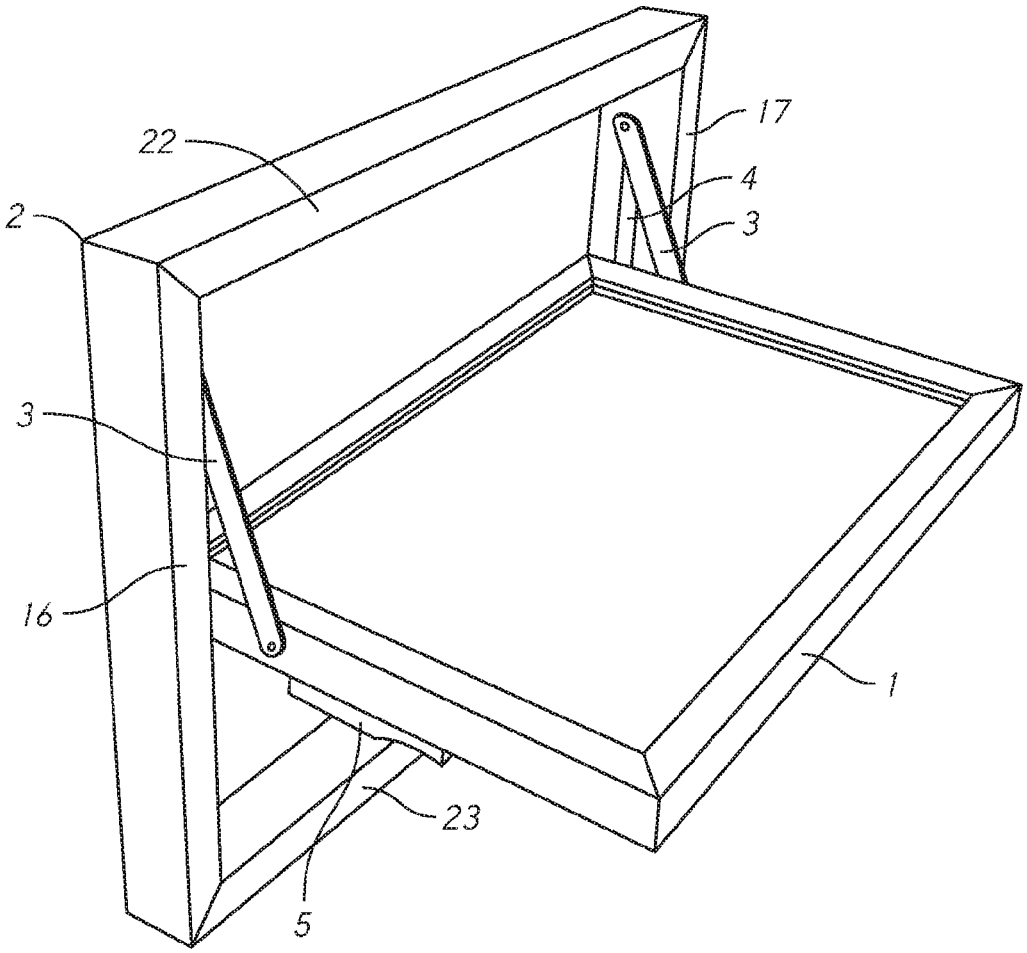
FIG. 4 shows a perspective side view of the open top hopper window.
Figure 6:
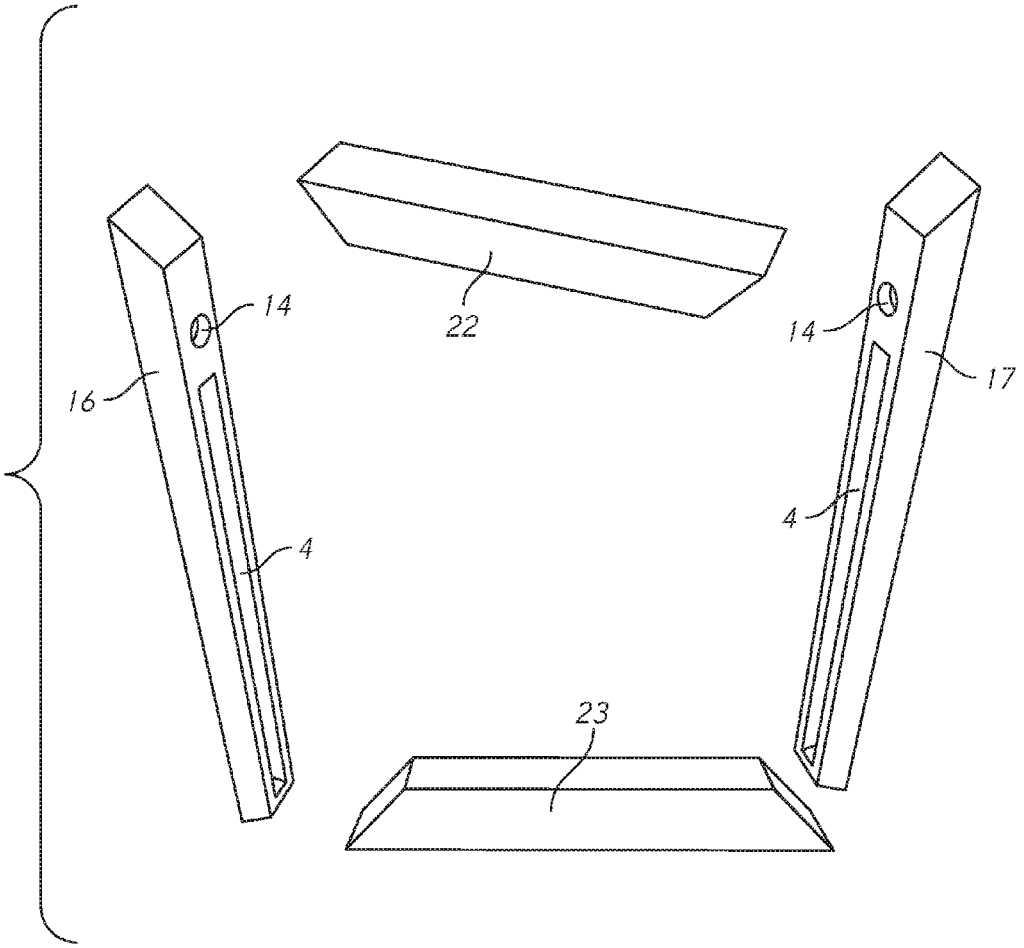
FIG. 6 show the parts that make up the frame of the hopper window.

This invention relates to an open top hopper window which consists of a hopper window (1) and a frame (2) (FIGS. 1 and 4). The frame comprises a top edge (22), a bottom edge (23), a left side (16) and a right side (17); the right and left sides of the frame (16 and 17) have a guide groove (4) located at the bottom with a hole in the frame (14) above it; the joining of the four sides of the frame (FIG. 6) generate an opening in which the hopper window (1) is placed closed. The frame can be made of metal "U" profile or square or rectangular tube; in addition, it can also be made of wood.

Figure 10:
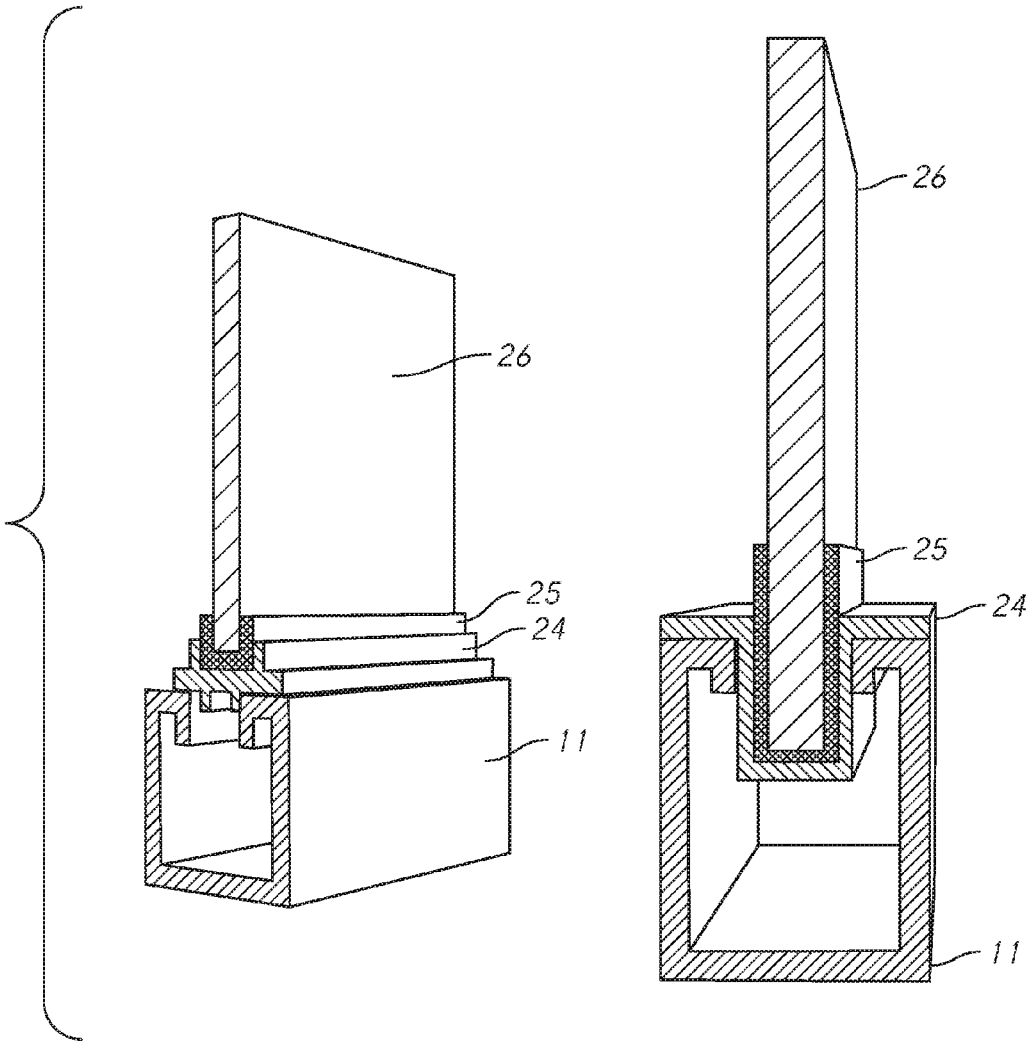
FIG. 10: Shows conventional means for securing the glass to the hopper window.

The hopper window (1) has the same size than the inner space generated by the joining of the four sides of the frame and in a preferred embodiment of the invention, it comprises four joined sides made of, for example, metal "U" profiles (11) with cover (24); it could also be made of square or rectangular tube or wood; the hopper window has a glass (26) which is fixed to such hopper window by conventional securing means, for example the profile or its cover may have two flanges in which the glass (26) of the hopper window is placed and fixed by rubber elements (31) (FIG. 10). Both the frame and the hopper window can be square or rectangular; the rectangular shape can be higher than wide or wider than high.

On the bottom, the hopper window (1) has two bolts (18) projecting outwardly on both outer sides; such bolts (18) fit into the guide grooves (4) located on the inner right and left sides of the frame (16, 17); this allows the sliding of the bottom of the hopper window through such guide grooves (4) allowing different opening positions between the bottom frame (2) and the hopper window (1).

Furthermore, the hopper window (1) is joined to the frame (2) at the top through two arms (3) made up by two bars which have on one end a bolt (19) that fits into the hole (14) at the frame (2), this bolt perpendicular to the bar has a suitable size to fit into the frame hole (14) located on the inside of the frame (2); and at the other end of the bars, there is a another bolt (7) located opposite to the bolt (19); bolt (7) fits into the hole (21) at the hopper window (1).

Figure 2:
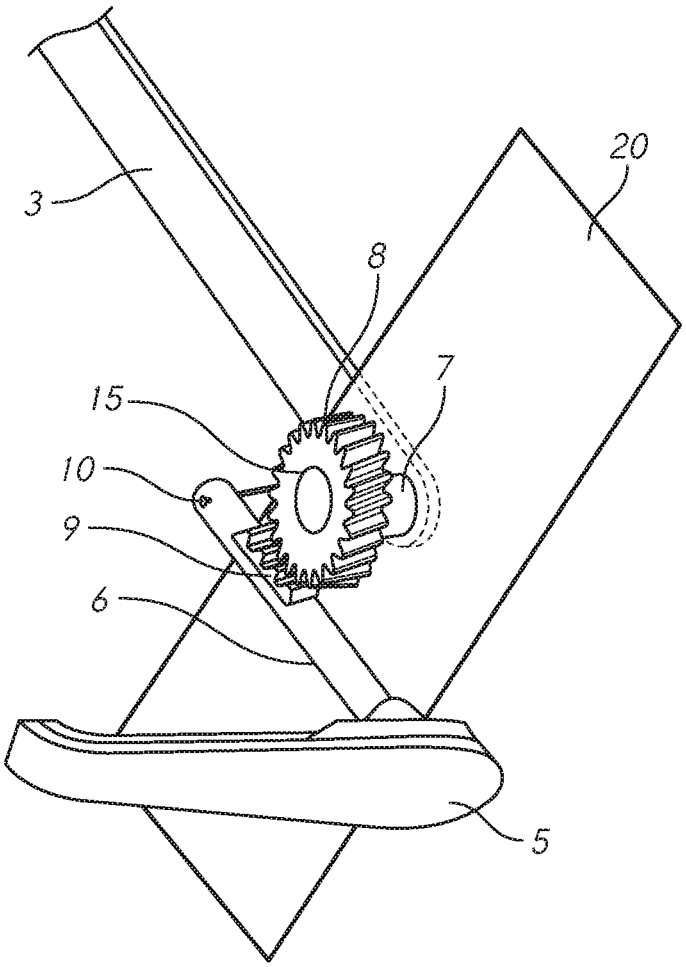
FIG. 2 shows the locking system; the half endless screw is locked against the gear, thus producing the arm locking.
Figure 3:
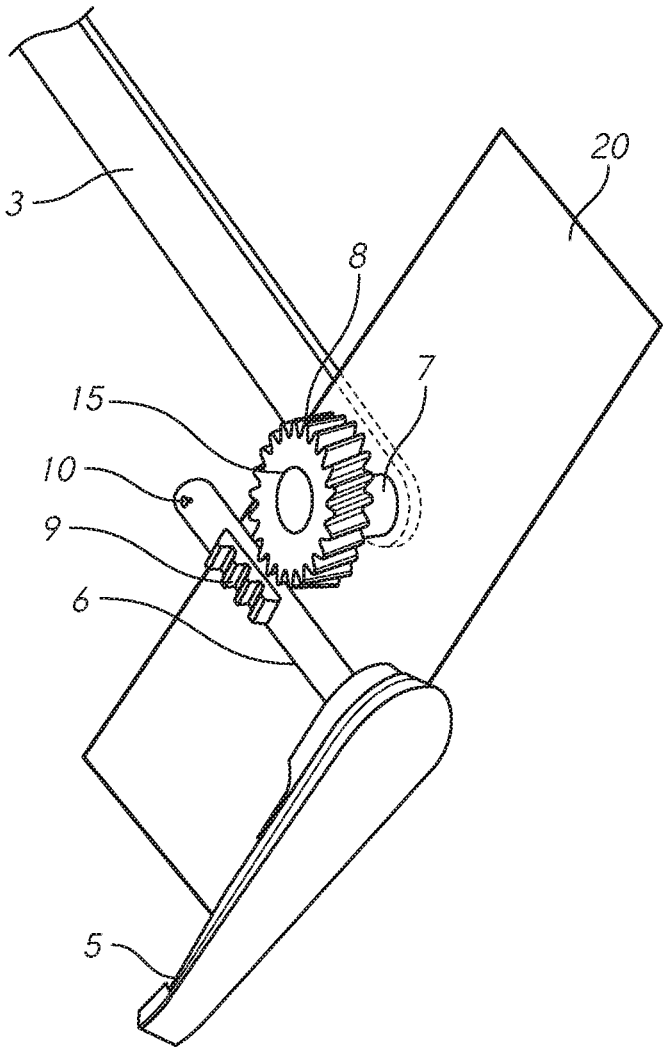
FIG. 3 shows the locking system; the half endless screw is away from the gear, thus producing the arm unlocking.
Figure 9:
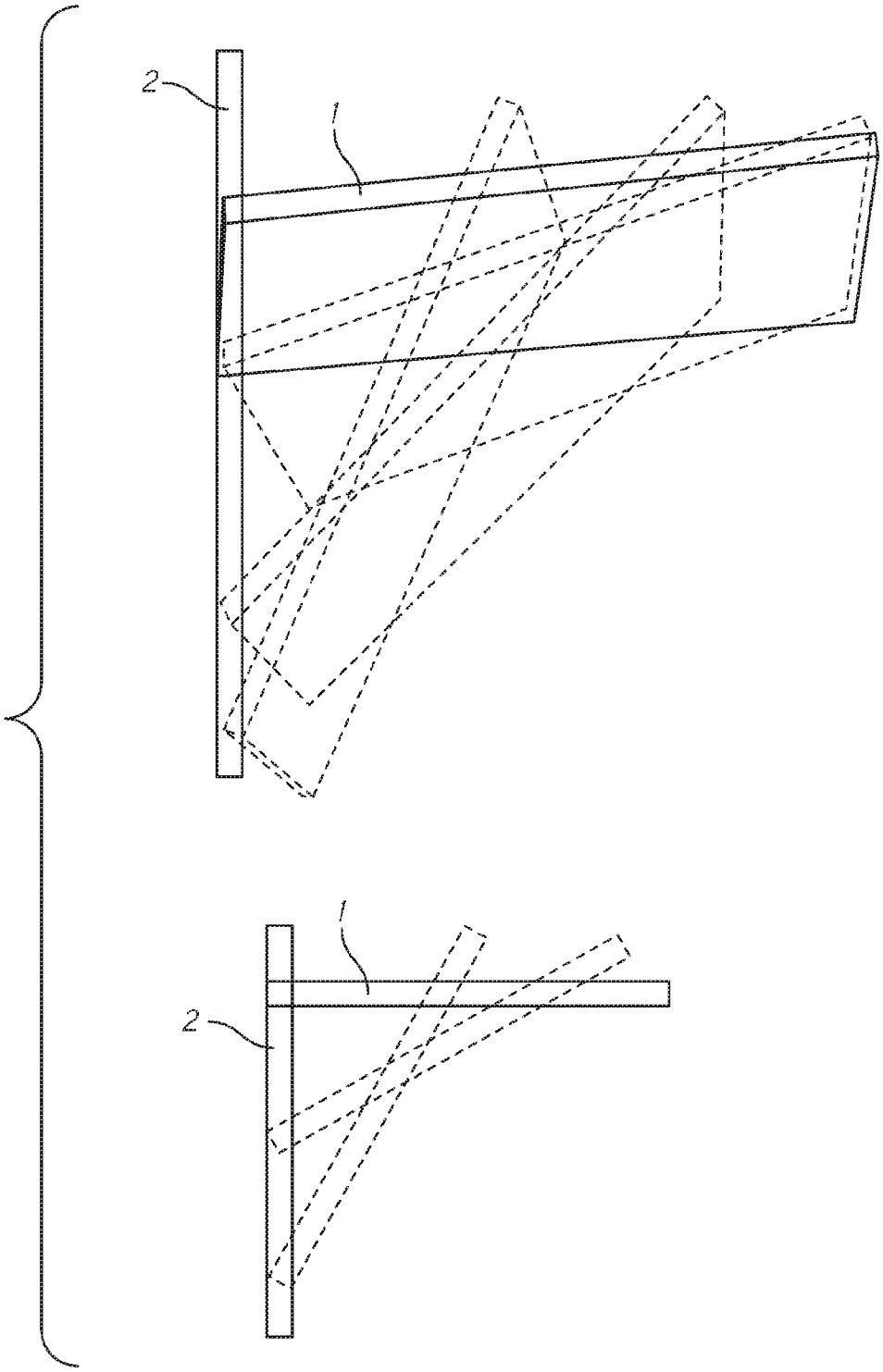
FIG. 9 shows the different positions of the hopper window in two options of the invention (rectangular and square windows).

The hopper window (1) may have at least one locking system to secure its desired opening angle (FIGS. 2, 3 and 9).

Figure 5:
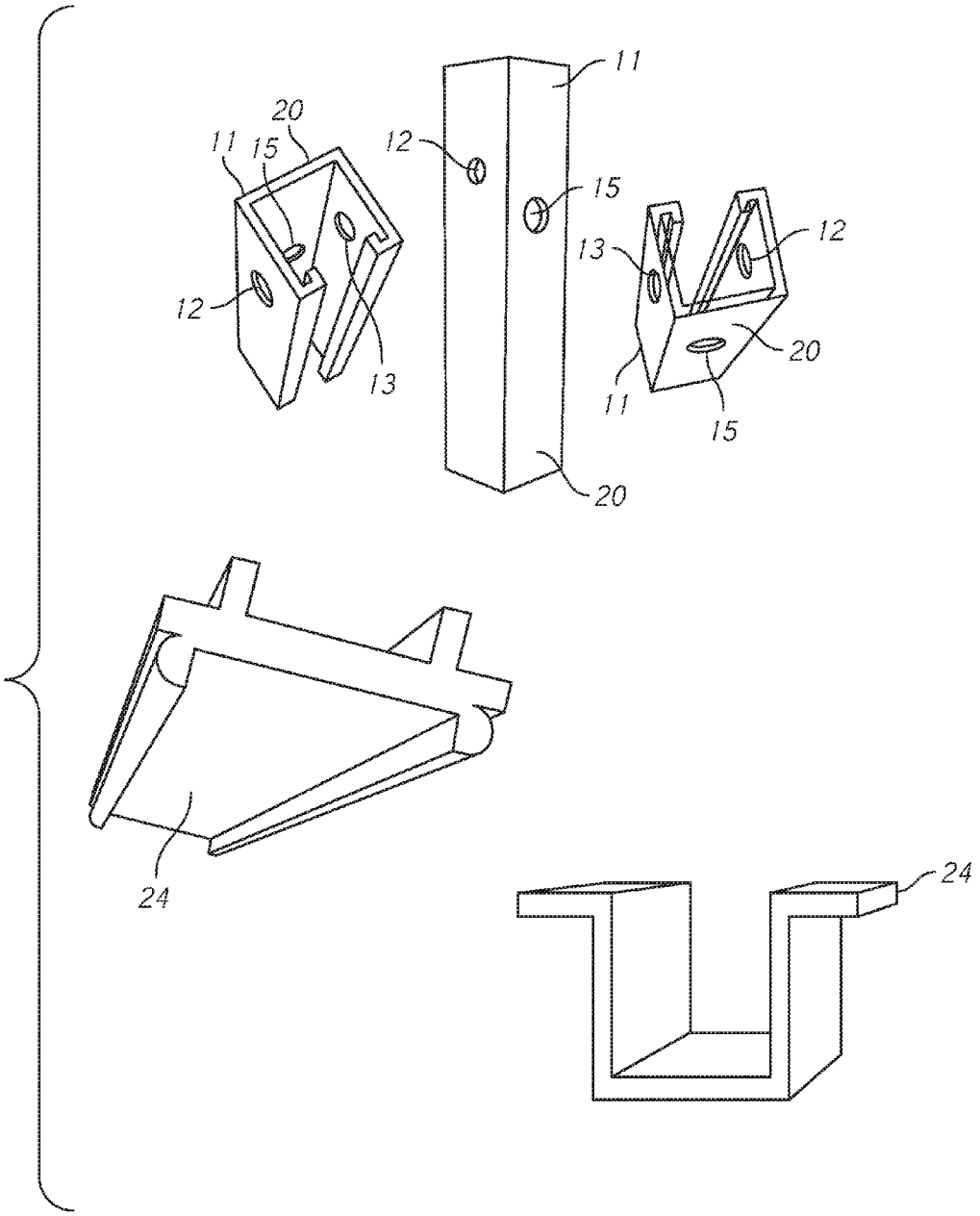
FIG. 5 shows three views of parts of the "U" profile that makes up the sides of the hopper window with two options of the cover at the bottom where the holding means of the glass of the hopper window are fixed.
Figure 7:
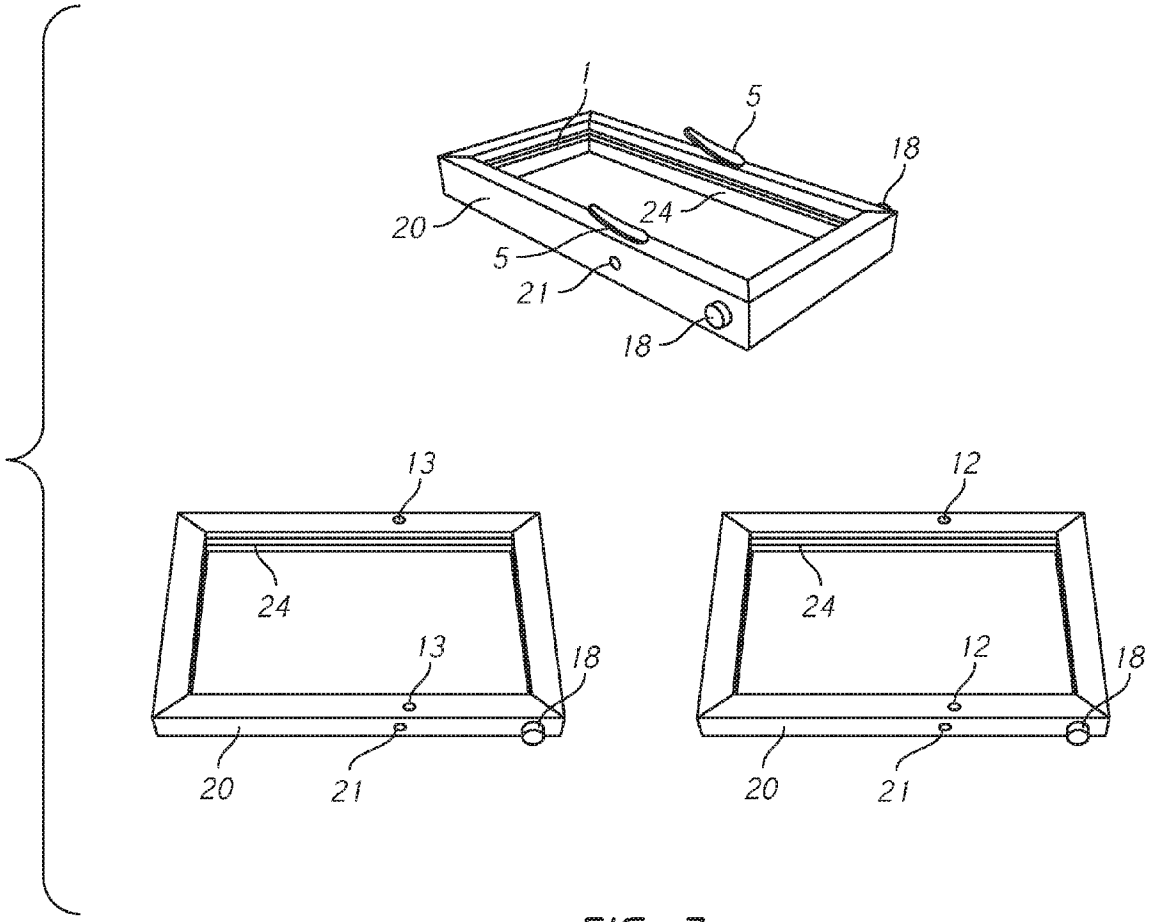
FIG. 7 shows a perspective view of an embodiment of the hopper window with two locking mechanisms on top and the hopper window made up of "U" profile from above and below at the bottom (top and bottom), showing all holes and stating the location in which they join with the arms at 35%-40% of the length of the hopper window.
Figure 8:
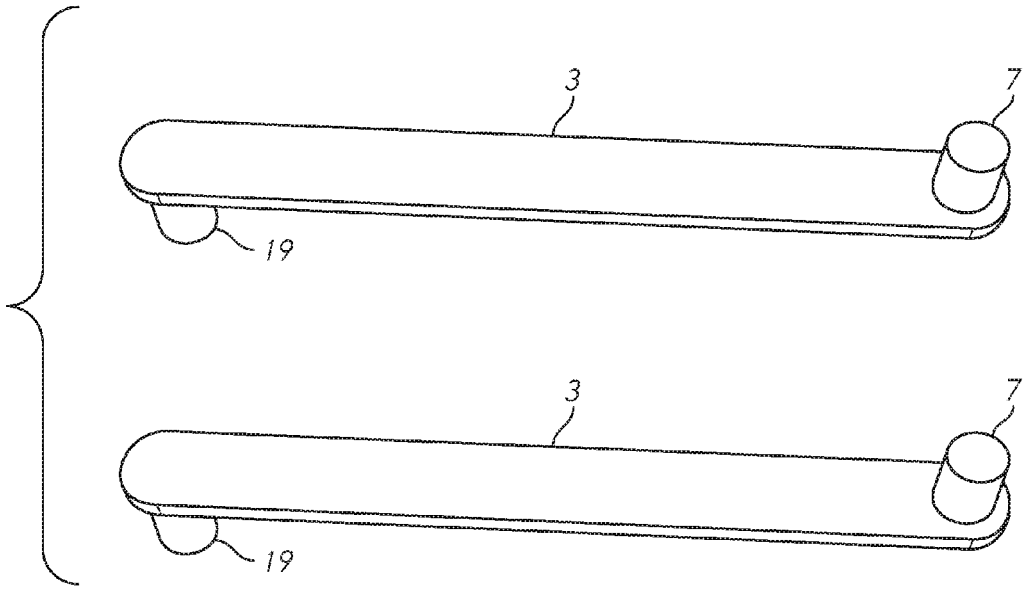
FIG. 8 shows the two arms that join the hopper window and the frame.

When the hopper window has locking system, the other bolt that fits into the hopper window shapes an axis of a gear (7), which is also perpendicular to the bars comprising the two arms (3). If the hopper window has two locking systems (one on each side), such gear axis (7) of each arm (3) fit into gear axis holes (12) located, as an example, at the bottom (24) of the "U" profiles (11) with cover (24) comprising two left and right sides of the hopper window (1) (FIGS. 5 and 7).

On each locking system, the gear axis (7) is joined to a gear (8) which is linked by a half endless screw (9) through helical teeth. This half endless screw (9) is crossed by a half endless screw axis (6) which passes through both sides of the "U" profile (11). For example, on the side of the hopper window (1) facing forward, the half endless screw axis (6) is attached to a handle (5) which allows regulating the position of the arm (3), by locking and unlocking such half endless screw (9) on such gear (8). The half endless screw axis (6) on the side where it joins the handle (5) passes through an aligned hole (13) on one side of the "U" profile (11), this aligned hole (13) has a center that matches with another aligned hole (12), the latter aligned hole (12) is crossed by the axis of the half endless screw (9) on the opposite side of the handle (5); such axis is held in position by means of a key (10) which crosses it out the "U" profile on the side opposite to the handle (5).

By moving the handle (5) which produces half rotation of the axis of half endless screw (6), it is achieved that the half endless screw (9) fits or not into the gear (8), thus locking or unlocking the position of the arm (3), releasing or fixing the hopper window at a desired opening position.

This way, the half endless screw (9) is held against the gear (8) overlapping the threads of the first one with the spaces between teeth of the second one, locking the locking system (FIG. 2).

By rotating the handle (5), it is possible to keep the gear (8) separate from the endless screw (14) so that the locking system becomes released (FIG. 3).

The set of endless screw (9), axis of the endless screw (6), gear (8), handle (5) with the related holes (12, 13 and 22) on the "U" profile (11) comprises the locking system (FIGS. 2 and 3).

On this open top hopper window, the hopper window is held by two bolts (24) sliding on the guide groove (4) of the frame at the bottom and by two arms (3) that support the hopper window (1), allowing its inward projection.

The joining of the arms (3) to each outer side of the hopper window is done at a 35%-40% range of the total length of the hopper window, while the length of the arms comprises 50% of the length of the hopper window; these features allow the user, regardless of the material in which the open top hopper window is made of, to always position it at any desired position within the allowed range and at any desired opening angle without effort due to the equilibrium position in which the arms are joined to the hopper window (35-40% of the total length).

The window of this invention prevents that the air getting into the room where they are set up hits directly on people; direct air on elderly is harmful since this may cause colds that affect their health and, in addition, this type of window allows ventilation at the top of the room.

The embodiments of the invention feature one or two locking systems, either located on a side of the hopper window or on both sides thereof. On large open top hopper windows, it is recommended to include two locking systems.

By means of the open top hopper window of this invention, it is allowed from minimum opening to full opening (FIG. 9) including a release or locking system, and the mere release of such system allows the window sliding and lifting without effort; this is due to the fact that by applying the lever shifted from the center of gravity, it turns the weight of the hopper window in favor of its lifting.

As shown herein, the levers are fixed on top with rotation on top of the frame and on the bottom end they fit into a wheel gear-half endless screw system rotated by an external handle. On this invention, the separation of the gear from the half endless screw can be achieved by rotating the handle.

NUMBER REFERENCES

1 hopper window
2 frame
3 arm
4 guide groove
5 handle
6 half endless screw axis
7 gear axis
8 gear
9 half endless screw
10 key
11 "U" profile
12 hole aligned at hopper window
13 hole aligned at hopper window
14 frame hole
15 gear axis hole
16 left frame side
17 right frame side
18 hopper window bolt
19 bolt of arm that fits into the frame
20 bottom of "U" profile
21 hopper window hole
22 top of frame
23 bottom of frame
24 cover of "U" profile
25 rubber element
26 glass According to the above mentioned, this invention covers the modifications and options thereof as long as they meet the scope of the attached claims and their equivalents.

The invention claimed is:

1. An open top hopper window comprising:

a hopper window including at least one locking system disposed at sides of the hopper window, the locking system comprising an elongated member having a half endless screw disposed about a surface of the elongated member, the half endless screw comprising helical threads, a gear having a gear axis hole and helical teeth separated by tooth spaces, the gear configured to rotate about a gear axis perpendicular to a member axis extending along a length of the elongated member, and a handle joined to the elongated member; and a frame joined to the hopper window, the frame having a top edge, a bottom edge, a left side, and a right side, inner parts of the left and right sides of the frame each having a guide groove disposed at the bottom edge and a frame hole defined in the frame above the guide groove, wherein the hopper window is joined to the frame by two bolts disposed on outer bottom edges of the hopper window sliding into the guide grooves and through two arms linking the holes in the frame with two holes in the hopper window on outer sides of the hopper window, the two arms are two bars each having at one end, a first bolt configured to fit into the frame hole, and at another end, a second bolt disposed opposite to the first bolt and configured to fit into the hole at the hopper window, the second bolt being configured to extend into the gear axis hole along a direction of the gear axis for the gear to rotate about thereto, and the elongated member is configured to be turned by an operational rotation of the handle to lock and unlock the half endless screw into engagement with and disengagement from the teeth of the gear.

2. The open top hopper window according to claim 1, wherein the hopper window comprises a joining of a plurality of "U" profiles that make up four sides of the hopper window.

3. The open top hopper window according to claim 2, wherein the axis of the half endless screw crosses both sides of the respective "U" profile through two aligned holes located, respectively, on each side of the "U" profile.

* * * * *